US008706020B2

(12) United States Patent
Park et al.

(10) Patent No.: US 8,706,020 B2
(45) Date of Patent: Apr. 22, 2014

(54) BOOKBINDING UNIT WITH A MOVABLE TRAY AND IMAGE FORMING APPARATUS HAVING THE SAME

(75) Inventors: Jeong Yeon Park, Hwaseong-Si (KR); Byung Sun Ahn, Suwon-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 544 days.

(21) Appl. No.: 12/624,148

(22) Filed: Nov. 23, 2009

(65) Prior Publication Data

US 2010/0133736 A1 Jun. 3, 2010

(30) Foreign Application Priority Data

Dec. 3, 2008 (KR) ..... 10-2008-0121840

(51) Int. Cl.
*G03G 15/00* (2006.01)
*B41L 43/00* (2006.01)
*B65H 39/00* (2006.01)

(52) U.S. Cl.
USPC ..... 399/407; 270/32; 270/58.07

(58) Field of Classification Search
USPC ..... 399/397, 405, 407, 408; 270/32, 46, 37, 270/4, 20.1, 58.07; 412/18, 19, 20, 22; 111/397, 405, 407, 408
See application file for complete search history.

(56) References Cited

U.S. PATENT DOCUMENTS

2008/0211158 A1* 9/2008 Fukasawa et al. ..... 270/1.01

FOREIGN PATENT DOCUMENTS

JP 61-012573 1/1986
JP 2007-296813 11/2007

OTHER PUBLICATIONS

English language abstract of JP 61-012573, published Jan. 20, 1986.
English language abstract of JP 2007-296813, published Nov. 15, 2007.
Machine English language translation of JP 2007-296813, published Nov. 15, 2007.

* cited by examiner

*Primary Examiner* — Judy Nguyen
*Assistant Examiner* — Justin Olamit
(74) *Attorney, Agent, or Firm* — Stanzione & Kim, LLP

(57) ABSTRACT

Disclosed are a bookbinding unit and an image forming apparatus having the same. The bookbinding unit includes a bookbinding unit main body, a pair of stack trays disposed in the bookbinding unit main body so as to support print media on the upper surfaces of the stack trays and a folding knife movable in the space between the pair of the stack trays to fold the print media on the stack trays and to move the folded print media into the space between the pair of the stack trays. The pair of the stack trays is rotatable in conformity with the movement of the print media into the space between the stack trays to provide a surface contact guiding of the folded print media.

23 Claims, 7 Drawing Sheets

BOOKBINDING UNIT WITH A MOVABLE TRAY AND IMAGE FORMING APPARATUS HAVING THE SAME

CROSS-REFERENCE TO RELATED APPLICATION

This application claims the benefit of Korean Patent Application No. 2008-0121840, filed on Dec. 3, 2008, in the Korean Intellectual Property Office, the entire disclosure of which is incorporated herein by reference.

TECHNICAL FIELD

The present disclosure relates generally to a bookbinding unit capable of binding print media and an image forming apparatus having the same.

BACKGROUND OF RELATED ART

An image forming apparatus is capable of forming an image on print media, such as, for example, sheets of paper. Examples of an image forming apparatus may include a printer, a copier, a fax machine and a multi-function peripheral that combine at least two functions of aforementioned.

Some image forming apparatuses include a bookbinding unit that receives from the image forming apparatus print media on which a complete image has been formed, and that binds together the received print media.

To that end, a bookbinding unit typically includes a pair of stack trays arranged side by side with a space gap between them. The received print media are stacked on the stack trays, and become folded when a folding knife presses and pushes the stacked print media through the space between the stack trays.

In such a bookbinding unit, a considerable portion of the pressing force exerted on the print media by the folding knife is concentrated near the space between the two stack trays, and as the folded print media are pushed through the space between the stack trays, the outermost print medium may be subjected to a significant frictional force by the edges of the two stack trays, and thus may become damaged.

SUMMARY OF DISCLOSURE

In accordance with one aspect of the present disclosure, a bookbinding unit may be provided to include a pair of stack trays and a folding knife. The pair of stack trays may have respective receiving surfaces capable of receiving thereon one or more print media. The folding knife may be configured to move through a space between the pair of the stack trays so as to cause the one or more print media received on the receiving surfaces of the pair of the stack trays to be folded and to move into the space between the pair of the stack trays. At least one of the pair of the stack trays may be rotatable in response to the movement of the print media into the space between the stack trays.

The bookbinding unit may further comprise a pair of hinges each of which being arranged near an end adjacent the space of corresponding respective one of the pair of stack trays, each of the pair of stack trays being rotatable about respective corresponding one of the pair of hinges.

The bookbinding unit may further comprise a main body configured to accommodate therein the pair of stack trays and the folding knife. Each of the pair of hinges may comprise a protrusion and a groove. The groove may be configured to receive thereinto the protrusion in such a manner allowing sliding movement of the protrusion along the groove so as to allow lateral and rotational movements of respective associated one of the pair of the pair of stack trays.

The bookbinding unit may further comprise a pair of return springs corresponding to the pair of stack trays and being configured to elastically bias the pair of stack trays toward a direction of returning the pair of stack trays to their original positions.

The pair of hinges may be spaced apart by an equal distance from respective ends of the corresponding respective one of the pair of stack trays.

Each of the pair of stack trays may further comprise a guide that extend at an incline with respect to the receiving surface thereof. The incline may be in the direction along which the one or more print media move into the space between the pair of the stack trays.

The bookbinding unit may further comprise a plurality of feed rollers disposed above the pair of stack trays and configured to guide the one or more print media toward the pair of stack trays.

The bookbinding unit may further comprise a stopper movably arranged adjacent the pair of stack trays. The stopper may be configured to contact edges of the one or more print media received on the pair of the stack trays so as to thereby position centers of the one or more print media at the space between the pair of the stack trays.

The bookbinding unit may further comprise a plurality of pressure rollers and a plurality of pressure springs. The plurality of pressure rollers may be disposed below, and so as to receive the one or more print media from, the space between the pair of the stack trays. The plurality of pressure springs may be configured to elastically bias the plurality of the pressure rollers toward one another.

According to another aspect, an image forming apparatus may be provided to include an image forming unit and a bookbinding unit. The image forming unit may be configured to form images on print media and to output image bearing print media on which the images have been formed. The bookbinding unit may be configured to receive the image bearing print media from the image forming unit. The bookbinding unit may comprise a pair of stack trays and a folding knife. The pair of stack trays may have respective receiving surfaces capable of supporting thereon the image bearing print media. The folding knife may be configured to move through a space between the pair of the stack trays so as to cause the image bearing print media supported on the receiving surfaces of the pair of the stack trays to be folded and to move into the space between the pair of the stack trays. At least one of the pair of the stack trays may be rotatable in response to the movement of the image bearing print media moving into the space between the stack trays.

According to yet another aspect, an apparatus for folding sheets of print media for bookbinding may be provided to include a pair of stack trays and a folding knife. The pair of stack trays may define respective receiving surfaces on which to receive the sheets of print media. The pair of stack trays may be movable between at least an original position and a folding position. A first angle between the respective receiving surfaces of the pair of stack trays when the pair of stack trays is in the original position may be different from a second angle between the respective receiving surfaces of the pair of stack trays when the pair of stack trays is in the folded position. The folding knife may be configured to move toward the pair of the stack trays to come into a pressing contact with, and to thereby cause folding of, the sheets of print media received on the receiving surfaces of the pair of the stack trays.

The respective receiving surfaces of the pair of stack trays may be substantially coplanar when the pair of stack trays is in the original position while the second angle between the respective receiving surfaces of the pair of stack trays may be an acute angle.

Alternatively, The respective receiving surfaces of the pair of stack trays may be substantially coplanar when the pair of stack trays is in the original position while the respective receiving surfaces of the pair of stack trays being substantially parallel to each other when the pair of stack trays is in the folding position.

As another alternative, the first angle between the respective receiving surfaces of the pair of stack trays may be an obtuse angle while the second angle between the respective receiving surfaces of the pair of stack trays may be an acute angle.

Each of the pair of stack trays may be configured to rotate and to move laterally along a first direction substantially perpendicular to a second direction along which the folding knife moves.

BRIEF DESCRIPTION OF THE DRAWINGS

Various features and aspects of the present disclosure will become apparent and more readily appreciated from the following description of the embodiments, taken in conjunction with the accompanying drawings in which.

DETAILED DESCRIPTION OF SEVERAL EMBODIMENTS

Figure 1:
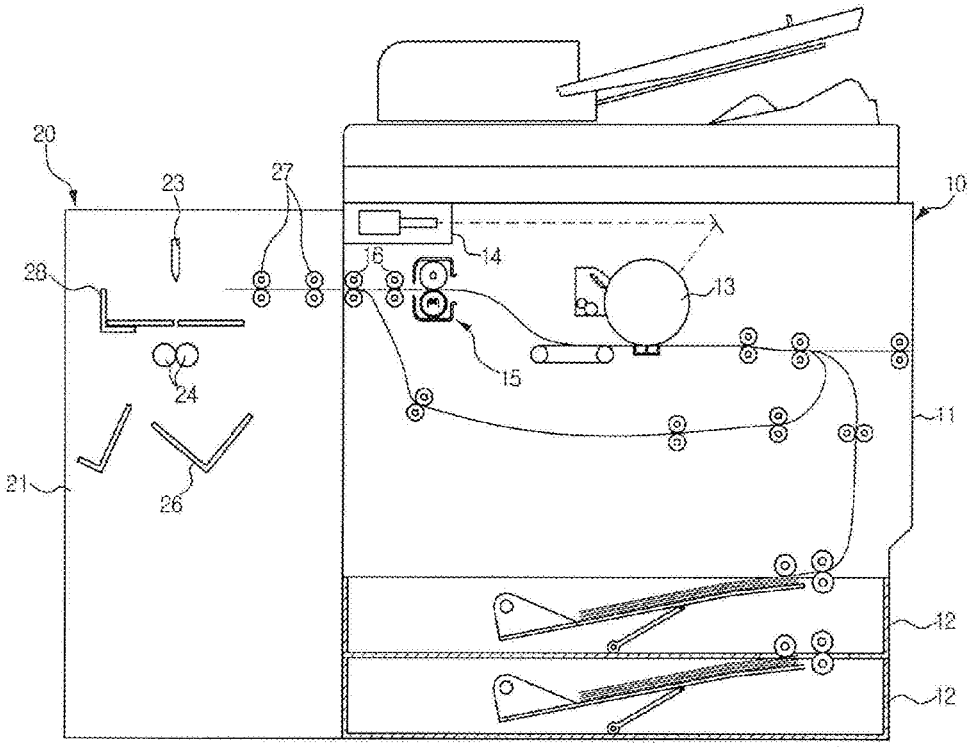
FIG. 1 is a schematic view of an image forming apparatus having a bookbinding unit according to an embodiment of the present disclosure.

Reference will now be made in detail to the embodiments of the present disclosure, examples of which are illustrated in the accompanying drawings, wherein like reference numerals refer to the like elements throughout.

As shown in FIG. 1, a bookbinding unit 20 according to an embodiment of the present disclosure may be arranged on a side of the image forming apparatus 10 to receive therefrom print media, on which the formation of the image has been completed, and may bind the received print media.

By way of an illustrative example, the image forming apparatus 10 may include an image forming apparatus main body 11 that defines the external appearance of the image forming apparatus 10, print medium cassettes 12 storing and supplying print media, an exposure unit 14 configured to irradiate light onto and to thereby form an electrostatic latent image on the surface of a photoreceptor 13, the photoreceptor 13 configured to carry on the surface thereof a toner image produced by developing the electrostatic latent image with toner, a fusing unit 15 configured to fix the toner image onto the print media after the toner image had been transferred to the print media from the photoreceptor 13 and exit rollers 16 to discharge the print media that bear the fixed toner image to the outside of the image forming apparatus main body 11.

In an image forming apparatus of the above-described configuration, when a print medium supplied by the print medium cassettes 12 reaches the photoreceptor 13, the toner image is transferred from the photoreceptor 13 to the print medium, and, subsequently, when the print medium passes through the fusing unit 15, the transferred toner image is fused or fixed onto the print medium. After the formation of the image on the print medium is completed, the print medium bearing the fixed image is discharged to the bookbinding unit 20 by the exit rollers 16.

Figure 2:
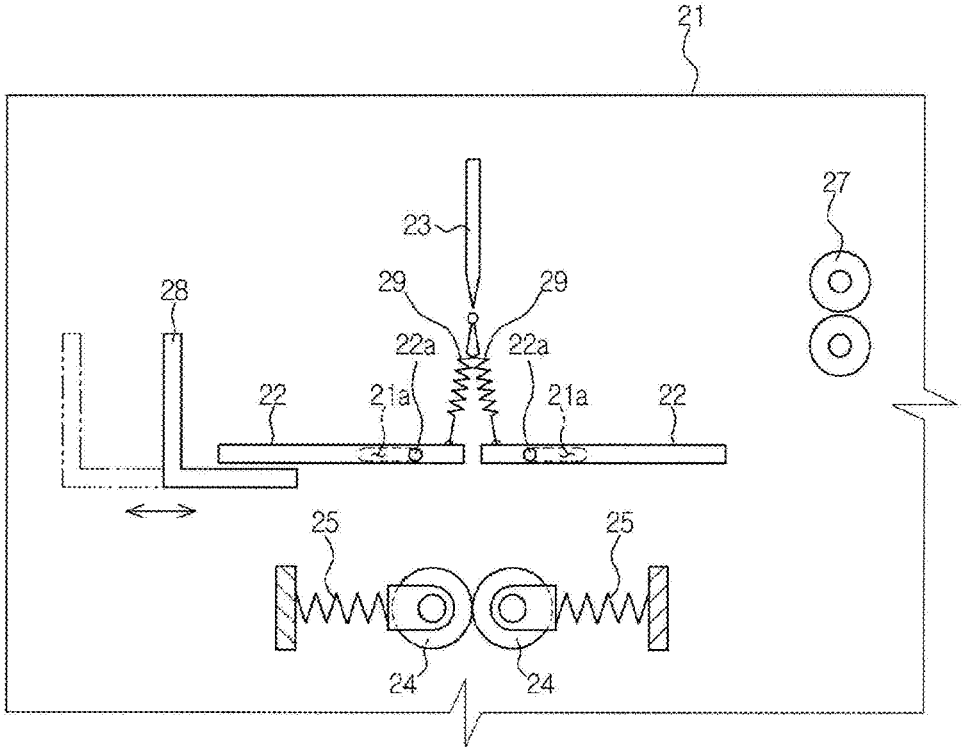
FIGS. 2 to 5 are schematic views illustrative of the configuration and operation of a bookbinding unit according to an embodiment of the present disclosure.
Figure 3:
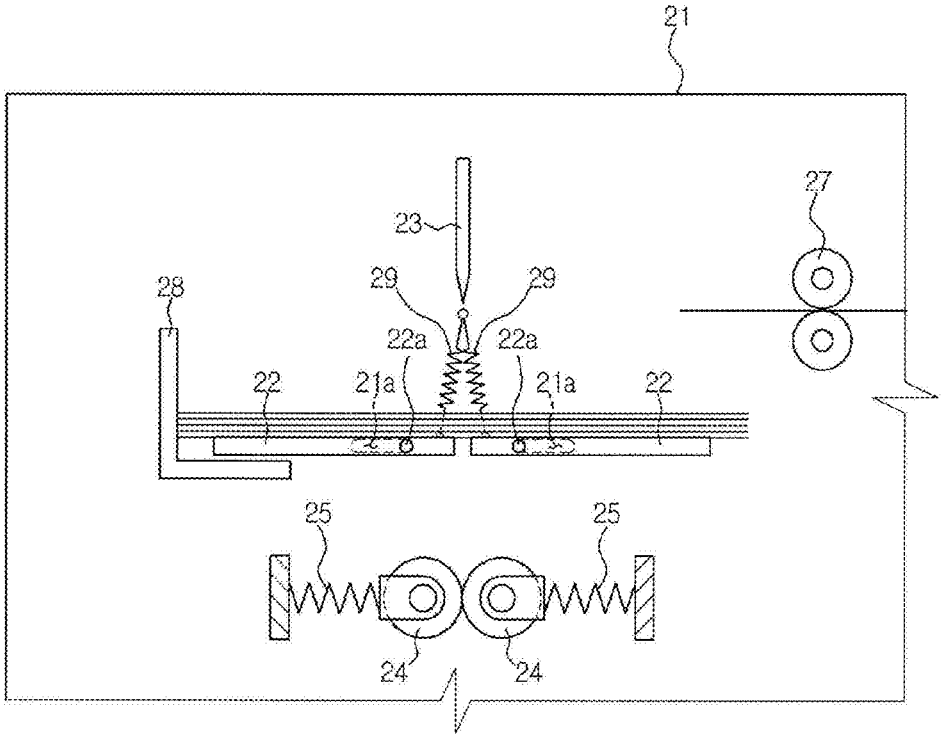

The bookbinding unit 20 according to an embodiment, as shown in more detail in FIGS. 2 and 3, may include a bookbinding unit main body 21 that defines the external appearance of the bookbinding unit 20, and that accommodates therein a pair of stack trays 22 and a folding knife 23. The stack trays 22 may be arranged to be spaced apart from each other and to each extend horizontally so as to provide surfaces upon which the received print media may be stacked. The folding knife 23 may be arranged above the space between the two stack trays 22, and may be movable vertically into the space between the two stack trays 22 so as to allow a plurality of the print media stacked on the stack trays 22 to be folded and pushed into the space between the stack trays.

A pair of pressure rollers 24 may be provided below the space between the pair of the stack trays 22 to support the sides of the folded stack of print media that has passed through the space between the pair of the stack trays 22, and to thereby maintain the folded state of the print media. The pressure rollers 24 may be elastically supported by the pressure springs 25, and thus are capable of providing a pressing support of the print media entering the space between the stack trays 22.

A storage tray 26 (shown in FIG. 1) may be arranged below the pair of the pressure rollers 24 so as to receive the folded stack of print media from the pressure rollers 24.

Feed rollers 27 may be positioned in the bookbinding unit main body 21 to receive the print media, on which the formation of the image has been completed, from the image forming apparatus 10, and to feed the received print media to the stack trays 22. A stopper 28 may be provided in the bookbinding unit main body 21, and may be arranged to move laterally so as to allow the centers of the print media to be positioned at the space between the pair of the stack trays 22 adaptively according to the various sizes of the print media.

The pair of the stack trays 22 in accordance with an embodiment is arranged in the main bookbinding unit body 21 such that the stack trays 22 are rotatable to be in a surface contact with the print media passing through the space between the pair of the stack trays 22, which may reduce the likelihood of damaging the print media. According to an embodiment, as the print media passes through the space between the pair of the stack trays 22, the print media become gradually folded into a V shape by the folding knife 23. The stack trays 22 are arranged to rotate due to the pressing force of the print media by rotational angles in conformity with the shape of the folded stack of print media so as to guide the side surfaces of the print media with the surfaces of the two stack trays 22. Therefore, the force applied by the folding knife 23 need not be concentrated on small regions of the stack trays 22, but may advantageously be dispersed over a wider area of the surfaces of the stack trays 22. Thus, it may be possible to reduce the likelihood of damages to the print media, which may be generated when force is concentrated on smaller regions of the stack trays 22.

The hinge parts 22*a* may rotatably support the stack trays 22, may each be provided at a position near one end of the corresponding stack tray 22 so as to protrude therefrom through the corresponding one of the long holes or grooves 21*a* formed on the bookbinding unit main body 21. The long holes 21*a* may be arranged to extend horizontally substantially parallel to the stack trays 22 in their initial un-rotated positions. The hinge parts 22*a* may be slidably coupled to the long holes 21*a* so as to allow sliding movement of the hinge parts 22*a* along the long holes 21*a* to thereby allow the rotational and/or lateral movements of the stack trays 22. According to an embodiment, the hinge parts 22*a* may be positioned to be spaced apart from the respective corresponding opposing ends of the stack trays 22 by a distance, which may be determined taking into consideration the space between the stack trays 22 that allows the folded print media to pass therethrough. It should be noted that the above described configuration of the hinged parts 22*a* and grooves 21*a* are provided merely as an illustrative example, and that other configurations are also possible. For example, in an alternative embodiment, the hinged parts 22*a* may be provided to protrude from the bookbinding unit main body 21 while the long holes 21*a* are formed along the stack trays 22 to receive the hinged parts 22*a* therethrough.

The return springs 29 may be provided to provide an elastic bias to the stack trays 22 in the direction of returning the stack trays 22 to their initial un-rotated positions. For example, one end of a return spring 29 may be secured to an end portion of the corresponding stack tray 22 while the other end of the return spring 29 is secured to the bookbinding unit main body 21.

Figure 4:
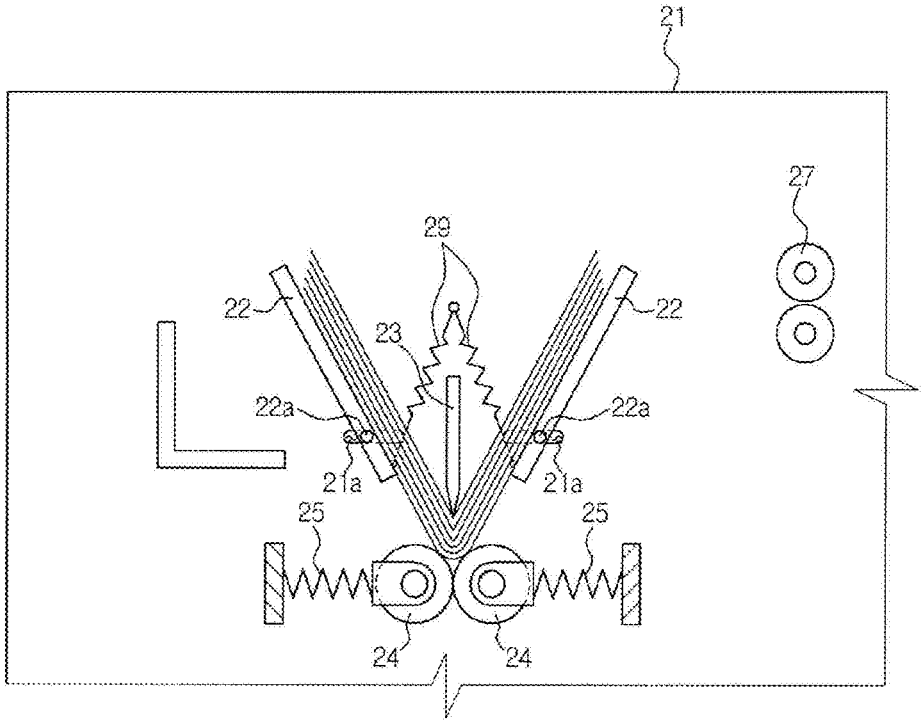
Figure 5:
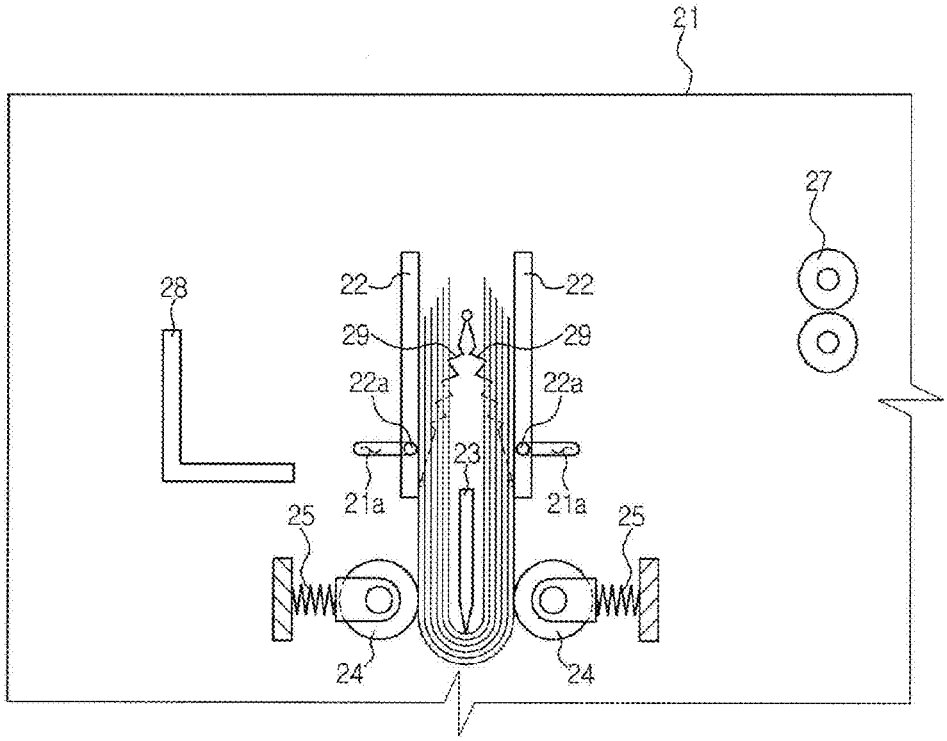

With the above described configurations, when a number of the print media are received and stacked on the two stack trays 22, as illustrated in FIG. 3, the folding knife 23 is allowed to descend and to apply pressure on the print media, for example, at the center of the print media stack, so as to fold the print media stack, for example, into a V shape so that the folded print media stack enters the space between the two stack trays 22 as illustrated in FIG. 4. In response to the force of the print media stack moving through the space between the stack trays 22, the stack trays 22 may move laterally away from each other, and may rotate in such manner that the surfaces thereof are in general conformity with the surfaces of the print media stack as also shown in FIG. 4. The folded print media stack continues to move downward, and passes between the pair of pressure rollers 24 provided below the pair of the stack trays 22, causing the pair of the pressure rollers 24 to in turn move apart as shown in FIG. 5. The pressure rollers 24 receive increased amounts of elastic force from by the pressure springs 25, and, as a result, press against the side surfaces of the folded print media, furthering the folding of the print media. Having passed through the pressure rollers 24, the folded print media may be received and stored in the storage tray 26 provided below the two pressure rollers 24. After the print media have passed through the stack trays 22, the stack trays 22 may return to the original horizontal positions by the application of the elastic force exerted by the return springs 29.

Figure 6:
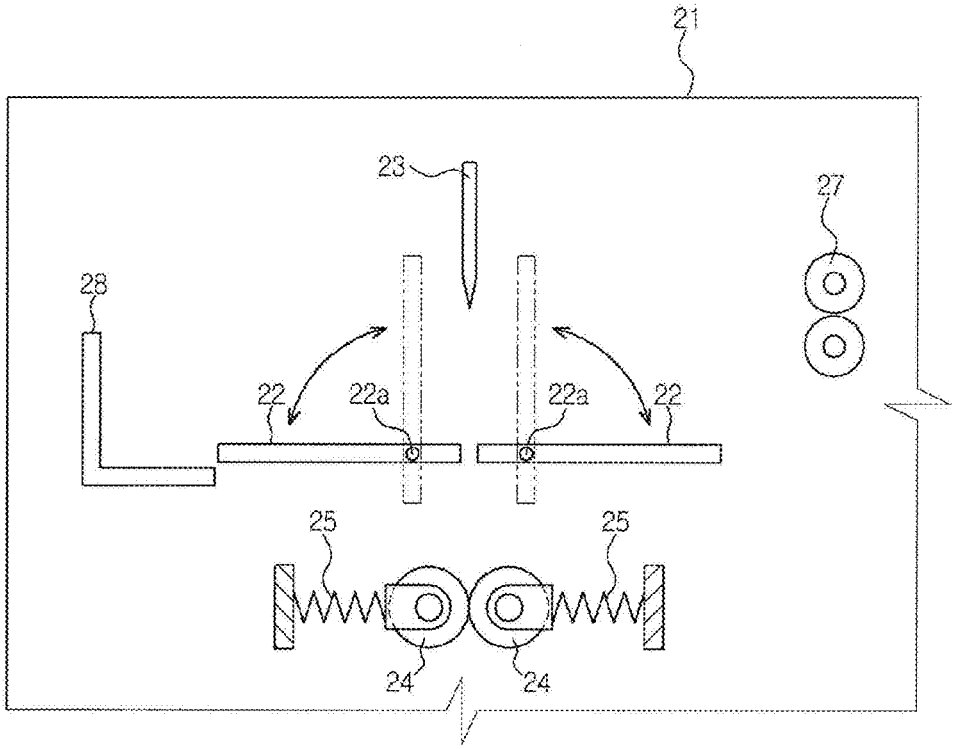
FIG. 6 is a schematic view illustrating the operation of a bookbinding unit according to another embodiment of the present disclosure.

According to another embodiment, as shown in FIG. 6, in lieu of the protrusion and groove arrangement of the previously described embodiments, the stack trays 22 may be arranged to pivot about hinge parts 22*a* that may be supported on the bookbinding unit main body 21.

With such configuration shown in FIG. 6, when the folding knife 23 descends and applies pressure to the centers of print media stacked on the stack trays 22, the print media stacked on the stack trays 22 are folded around the centers thereof into a V shape, and enter the space between the two stack trays 22, causing the stack trays 22 to rotate upwardly along the respective directions indicated by the arrows. The folded print media pass through the space between the stack trays 22, and continue to move further downward to move past between the pair of pressure rollers 24 that are elastically supported by the pressure springs 25 receiving further folding pressure. Having passed through the space between the pair of the pressure rollers 24, the folded print media fall into the storage tray 26 provided below the two pressure rollers 24. With such configuration as shown in FIG. 6, after the print media have passed through the stack trays 22, the stack trays 22 may be rotated in the opposite directions by their own weight due to gravity so as to return to their original horizontal positions.

Figure 7:
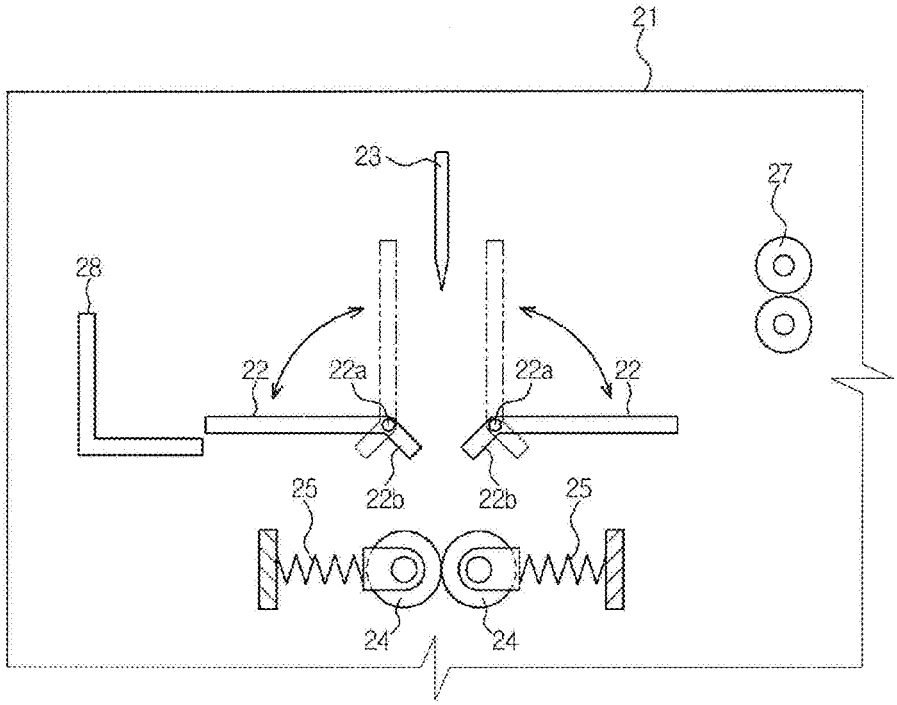
FIG. 7 is a schematic view illustrating the operation of a bookbinding unit according to yet another embodiment of the present disclosure.

According to another alternative embodiment, as shown in FIG. 7, in order to more effectively fold the print media, guide parts 22*b* may be arranged at the ends of the two stack trays 22 to extended at a downward incline, i.e., in the direction of conforming to the print media, with respect to the remaining portions of the stack trays 22. That is, according to an embodiment, the two guide parts 22*b* are respectively provided on the two stack trays 22 to collectively form a V shape to further assist the folding of the print media into the V shape. While in FIG. 7, the guide parts 22*b* are shown as being added to an embodiment of the bookbinding unit 20 of the configuration shown in FIG. 6, it should be noted that the guide parts 22*b* can also be added to the stack trays 22 according to any other embodiments.

As is apparent from the above description, according to an aspect of the present disclosure, the provision of rotatable stack trays 22 in the bookbinding unit 20 may afford a reduction in the likelihood of damages to print media during binding process by, for example, providing a wider surface contact between the print media and the stack trays 22 as the print media passes between the stack trays 22, allowing a dispersion of the folding force over wider surface(s).

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. A bookbinding unit, comprising:

a pair of stack trays having respective receiving surfaces capable of receiving thereon one or more print media; and a folding knife configured to move through a space between the pair of the stack trays so as to cause the one or more print media received on the receiving surfaces of the pair of the stack trays to be folded and to move into the space between the pair of the stack trays, wherein the pair of the stack trays is rotatable and slidable by a force of a movement of the one or more print media into the space between the stack trays, the force of the movement of the one or more print media pressing the stack trays.

2. The bookbinding unit according to claim 1, further comprising a pair of hinges each of which being arranged near an end adjacent to the space of a corresponding one of the pair of the stack trays, each of the pair of the stack trays being rotatable about a corresponding one of the pair of hinges.

3. The bookbinding unit according to claim 2, further comprising a main body configured to accommodate therein the pair of the stack trays and the folding knife, wherein each of the pair of hinges comprises a protrusion and a groove, the groove being configured to receive thereinto the protrusion in such a manner to allow a sliding movement of the protrusion along the groove so as to allow lateral and rotational movements of the corresponding one of the pair the stack trays.

4. The bookbinding unit according to claim 3, further comprising a pair of return springs corresponding to the pair of the stack trays and being configured to elastically bias the pair of the stack trays toward a direction of returning the pair of the stack trays to their original positions.

5. The bookbinding unit according to claim 2, wherein each of the pair of hinges is spaced apart by an equal distance from a respective end of the corresponding one of the pair of the stack trays.

6. The bookbinding unit according to claim 2, wherein each of the pair of stack trays further comprises a guide that extend at an incline with respect to the receiving surface thereof, the incline being in a direction along which the one or more print media move into the space between the pair of the stack.

7. The bookbinding unit according to claim 1, further comprising a plurality of feed rollers disposed above the pair of the stack trays and configured to guide the one or more print media toward the pair of the stack trays.

8. The bookbinding unit according to claim 1, further comprising a stopper movably arranged adjacent to the pair of the stack trays and configured to contact edges of the one or more print media received on the pair of the stack trays so as to thereby position centers of the one or more print media at the space between the pair of the stack trays.

9. The bookbinding unit according to claim 1, further comprising:

a plurality of pressure rollers disposed below, and so as to receive the one or more print media from, the space between the pair of the stack trays; and a plurality of pressure springs configured to elastically bias the plurality of the pressure rollers toward one another.

10. The bookbinding unit according to claim 1, wherein the pair of the stack trays are disposed to be symmetrical to each other with respect to a position of the folding knife.

11. The bookbinding unit according to claim 1, wherein the pair of the stack trays are configured to rotate while maintaining a contact with the one or more print media.

12. The bookbinding unit according to claim 1, wherein the pair of the stack trays are configured to rotate in conformity with a shape of a folded stack of the one or more print media when a force of a movement of the folding knife is applied.

13. An image forming apparatus, comprising:

an image forming unit configured to form images on print media and to output image bearing print media on which the images have been formed; and a bookbinding unit configured to receive the image bearing print media from the image forming unit, the bookbinding unit comprising:

a pair of stack trays having respective receiving surfaces capable of supporting thereon the image bearing print media; and a folding knife configured to move through a space between the pair of the stack trays so as to cause the image bearing print media supported on the receiving surfaces of the pair of the stack trays to be folded and to move into the space between the pair of the stack trays, wherein the pair of the stack trays is rotatable and slidable by a force of a movement of the image bearing print media into the space between the stack trays, the force of the movement of the image bearing print media pressing the stack trays.

14. The image forming apparatus according to claim 13, wherein the bookbinding unit further comprises a pair of hinges each of which being arranged near an end adjacent to the space of a corresponding one of the pair of the stack trays, each of the pair of the stack trays being rotatable about a corresponding one of the pair of hinges.

15. The image forming apparatus according to claim 14, wherein the bookbinding unit further comprises a main body configured to accommodate therein the pair of the stack trays and the folding knife, and wherein each of the pair of hinges comprises a protrusion and a groove, the groove being configured to receive thereinto the protrusion in such a manner to allow a sliding movement of the protrusion along the groove so as to allow lateral and rotational movements of the corresponding one of the pair the stack trays.

16. The image forming apparatus according to claim 15, wherein the bookbinding unit further comprises a pair of return springs corresponding to the pair of the stack trays and being configured to elastically bias the pair of the stack trays toward a direction of returning the pair of stack trays to their original positions.

17. The image forming apparatus according to claim 14, wherein each of the pair of hinges is spaced apart by an equal distance from a respective end of the corresponding one of the pair of the stack trays.

18. The image forming apparatus according to claim 14, wherein each of the pair of stack trays further comprises a guide that extend at an incline with respect to the receiving surface thereof, the incline being in a direction along which the one or more print media move into the space between the pair of the stack.

19. An apparatus for folding sheets of print media for bookbinding thereof, comprising:

a pair of stack trays defining respective receiving surfaces on which to receive the sheets of print media, the pair of the stack trays being movable between at least an original position and a folding position, a first angle between the respective receiving surfaces of the pair of the stack trays when the pair of the stack trays is in the original position being different from a second angle between the respective receiving surfaces of the pair of the stack trays when the pair of the stack trays is in the folding position; and a folding knife configured to move toward the pair of the stack trays to come into a pressing contact with, and to thereby cause folding of, the sheets of print media received on the receiving surfaces of the pair of the stack trays and to thereby cause the pair of the stack trays to move from the original position to the folding position, wherein the pair of the stack trays is rotatable and slidable by a force of a movement of the print media into a space between the stack trays, the force of the movement of the sheets of print media pressing the stack trays.

20. The apparatus according to claim 19, wherein the respective receiving surfaces of the pair of the stack trays are substantially coplanar when the pair of the stack trays is in the original position, the second angle between the respective receiving surfaces of the pair of the stack trays being an acute angle.

21. The apparatus according to claim 19, wherein the respective receiving surfaces of the pair of the stack trays are substantially coplanar when the pair of the stack trays is in the original position, the respective receiving surfaces of the pair of the stack trays being substantially parallel to each other when the pair of the stack trays is in the folding position.

22. The apparatus according to claim 19, wherein the first angle between the respective receiving surfaces of the pair of stack trays is an obtuse angle, the second angle between the respective receiving surfaces of the pair of stack trays being an acute angle.

23. The apparatus according to claim 19, wherein each of the pair of the stack trays is configured to rotate and to move laterally along a third direction substantially perpendicular to a fourth direction along which the folding knife moves.

* * * * *